US005725102A

United States Patent [19]

Gustavsson

[11] Patent Number: 5,725,102

[45] Date of Patent: Mar. 10, 1998

[54] METHOD AND DEVICE FOR SEPARATING HEAVY PARTICLES FROM A PARTICULATE MATERIAL

[75] Inventor: Lennart Gustavsson, Vaxjo, Sweden

[73] Assignee: ABB Fläkt AB, Stockholm, Sweden

[21] Appl. No.: 553,508

[22] PCT Filed: Jun. 16, 1994

[86] PCT No.: PCT/SE94/00591

§ 371 Date: Nov. 30, 1995

§ 102(e) Date: Nov. 30, 1995

[87] PCT Pub. No.: WO95/00261

PCT Pub. Date: Jan. 5, 1995

[30] Foreign Application Priority Data

Jun. 18, 1993 [SE] Sweden ..... 9302114

[51] Int. Cl.[6] ..... B07B 7/04

[52] U.S. Cl. ..... 209/143; 209/146; 209/154

[58] Field of Search ..... 209/23, 138, 139.1, 209/142, 143, 146, 147, 154; 34/114, 116, 117, 460, 641

[56] References Cited

U.S. PATENT DOCUMENTS

| | | | |
|---|---|---|---|
| 2,674,374 | 4/1954 | Elliott et al. | 209/477 X |
| 4,416,070 | 11/1983 | Vedenpa et al. | 34/116 X |
| 4,712,277 | 12/1987 | Gustavsson | 19/296 |
| 4,872,972 | 10/1989 | Wakabayashi et al. | 209/143 |

FOREIGN PATENT DOCUMENTS

| | | |
|---|---|---|
| 0 224 892 | 6/1987 | European Pat. Off. . |
| 0 266 778 | 5/1988 | European Pat. Off. . |
| 1482424 | 6/1969 | Germany . |
| 755-324 | 8/1980 | Russian Federation . |
| 457729 | 1/1989 | Sweden . |
| WO 92/05882 | 4/1992 | WIPO . |

*Primary Examiner*—Tuan Nguyen

*Attorney, Agent, or Firm*—Burns, Doane, Swecker & Mathis, L.L.P.

[57] ABSTRACT

In a method for separating heavy particles from a particulate material containing such heavy particles, use is made of a device having a Coanda sifter, which is adapted to receive a flow of the particulate material and which has a downwardly-facing, convexly single-curved surface (9), and a zigzag sifter (13) arranged after the Coanda sifter and having a plurality of zig-zag-shaped vertical walls (14) which are perpendicular to the axis of curvature of the single-curved surface (9) and define between them channels (15) extending upwards in zig-zag fashion. The particulate material is transported to the Coanda sifter and is conducted over its convexly single-curved surface (9) to have imparted to it a direction of motion (P1, P2) which is dependent on the weight of the particles and in which the particles are guided into the zigzag sifter (13). The particles are guided into the channels (15) of the zigzag sifter (13) in the lower portions thereof and from the side parallel to the channel walls (14). The particles are transported up through the channels (15) with the aid of a flow of transport air which is so adjusted that the heavy particles are separated in the zigzag sifter. (13).

7 Claims, 1 Drawing Sheet

1
2
3
4
5
6
7
7'
8
9
10
11
12
13
14
14'
15
16
17
18
19
20
20a
20b
21
P1
P2
II

METHOD AND DEVICE FOR SEPARATING HEAVY PARTICLES FROM A PARTICULATE MATERIAL

BACKGROUND AND SUMMARY OF THE INVENTION

The present invention relates to a method for separating heavy particles, such as latex particles, from a particulate material, such as wood fibres produced from rubber trees, which contains such heavy particles and which is transported by means of air from a first station, such as a container, to a second station, such as a plant for manufacturing fibreboards. The invention also relates to a device for carrying out the method.

In the manufacture of fibreboards, wood fibres are pneumatically transported, first from a drying plant to a collecting container and thence to a forming station. In the forming station, the fibres are placed as a mat on a wire, through which the transport air is sucked off. The fibre mat is thereafter pressed into fibreboards under given pressure and temperature conditions.

In the manufacture of fibreboards, it is essential that contaminants in the form of heavy particles be separated from the flow of material. In a method, known from PCT/SE91/00603 (SE 9003092-5), for separating large-size and hence heavy particles from the wood fibres when transported from the collecting container to the forming station, the wood fibres are introduced into a settling chamber as a downwardly-directed flow of material via a downwardly-facing settling chamber inlet, and is transported away from the settling cheer as an upwardly-directed flow of air-material via a settling chamber outlet disposed beside the inlet. Jets of compressed air, directed obliquely at the downwardly-directed flow of material, are blown into the settling chamber in order to decelerate the flow of material and to spread it in the transverse direction towards the outlet, the flow of transport air being blown into the settling chamber so as to encounter from below the decelerated and spread flow of material and, together with it, form the above-mentioned flow of air-material.

While this known method has proved to serve its purpose quite well for separating heavy particles in the form of glue lumps and fibre flocks from a particulate material in the form of glue-coated wood fibres, it yields an unsatisfactory result when separating heavy particles in the form of latex particles from a particulate material in the form of wood fibres produced from rubber trees.

One object of the present invention is to provide a method making it possible to efficiently separate also latex particles from wood fibres produced from rubber trees.

According to the invention, this object is achieved by a method which is of the type stated by way of introduction and which is characterised in that the particulate material in a substantially downwardly-directed flow is transported in known manner to a so-called Coanda sifter, in which the material is conducted over a downwardly-facing, convexly single-curved surface in order to impart to the particles a direction of motion which is dependent on the weight of the particles and in which the particles are guided into a so-called zigzag sifter disposed after the Coanda sifter and having a plurality of zigzag-shaped, substantially vertical walls which define between them channels extending upwards in zigzag fashion, the particles being guided into the channels of the zigzag sifter in the lower portions thereof and from the side substantially parallel to the walls, and that the particles are transported in known manner up through the zigzag-shaped channels by means of a flow of transport air which is so adjusted that the heavy particles are separated in the zigzag sifter.

Another object of the present invention is to provide a device for carrying out this method.

According to the invention, this object is achieved by means of a device which is characterised by a so-called Coanda sifter which is adapted in known manner to receive a substantially downwardly-directed flow of the particulate material and which has a downwardly-facing, convexly single-curved surface in order to impart To the particles a direction of motion dependent on the weight of the particles, and a so-called zigzag sifter disposed after The Coanda sifter and having a plurality of zigzag-shaped, substantially vertical walls which are substantially perpendicular to the axis of curvature of the single-curved surface and define between them channels which extend upwards in zigzag fashion, said zigzag sifter being adapted to receive the particles coming from the Coanda sifter, in its lower portion and from the side.

The folds defining the zigzag shape of the walls are inclined preferably 5°–20°, especially 15°, downwards in relation to the horizontal plane in a direction away from the Coanda sifter.

BRIEF DESCRIPTION OF THE DRAWINGS

The invention will now be described in more detail with reference to the accompanying drawings.

DETAILED DESCRIPTION

Figures 1, 2:
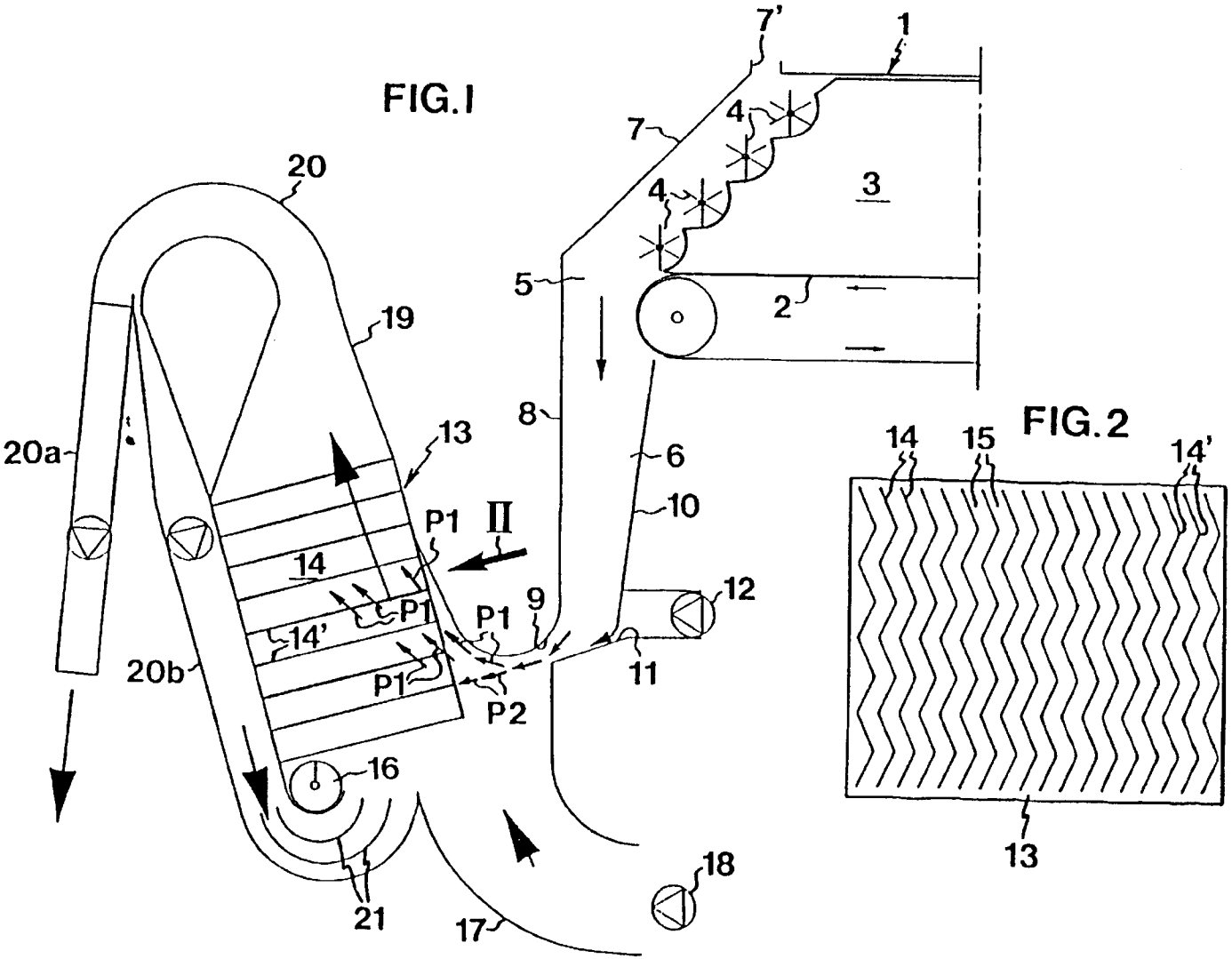
FIG. 1 schematically shows a device for separating heavy particles from a particulate material.
FIG. 2 shows a zigzag sifter included in the device of FIG. 1 in the direction of the arrow II in FIG. 1.

The device schematically illustrated in the drawings is arranged between a container 1, which holds wood fibres derived from rubber trees and containing contaminants in the form of heavy particles, such as latex particles, and a forming station (not shown), where fibreboards are formed.

The bottom of the container 1 consists of the upper run of an endless conveyor belt 2, on which a heap 3 of wood fibres is supported. A plurality of rotatable slushing rollers 4, provided with spikes or teeth, are arranged in the front part of the container 1 in order, as the conveyor belt 2 is discharging wood fibres from the container 1, to break up fibre flocks and lumps which have formed when storing the fibres in the container 1.

The container 1 has an outlet 5 which is located at the exit end of the conveyor belt 2 and communicates with a substantially vertical discharge shaft 6. The container 1 has a front wall 7 forming an extension of the front wall 8 of the shaft 6 and having an air intake 7' provided therein.

The front wall 8 of the shaft 6 passes at its lower portion into a downwardly-facing, convexly single-curved surface 9 which in the illustrated embodiment consists of the lower half of the outer circumferential surface of a horizontal, straight, circular cylinder. The surface 9 forms a so-called Coanda sifter known in the art, i.e. a sifter relying on the Coanda effect. A sifter of this type is described in more detail in Swedish Patent Specification 8505726-3. The rear wall 10 of the shaft 6 has in its lower portion, on a level with the Coanda sifter, an inlet opening 11. A fan 12 is adapted, via the opening 11, to blow a high-velocity air flow directed substantially at the surface 9 into the lower part of the shaft 6.

The wood fibres fed from the container 1 into the shaft 6 by means of the conveyor belt 2 are transported with the aid of the air flow towards the Coanda sifter. As a result of the Coanda effect, the air flow will follow the curved surface 9 and entrain the wood fibres (arrows P1 in FIG. 1), while the heavy particles are not deflected to the same extent, but follow a straighter path (arrows P2 in FIG. 1).

A so-called zigzag sifter 13 known per se is arranged immediately after the Coanda sifter for separating the heavy particles (latex particles, glue lumps etc). A zigzag sifter of this type is described in German Offenlegungsschrift 1,482,424. The zigzag sifter 13 has a plurality of zigzag-shaped, vertical metal sheets 14 (FIG. 2), which are perpendicular to the axis of curvature of the surface 9 and define between them channels 15 extending upwards in zigzag fashion. As shown in FIG. 1, the wood fibres (arrows P1) and the heavy particles (arrows P2) leaving the Coanda sifter are guided into the channels 15 of the zigzag sifter 13 in the lower portions thereof and from the side, i.e. parallel to the sheets 14. Then, the wood fibres and the heavy particles are distributed when entering the zigzag sifter 13 across the width of the channels 15, such that the heavy particles will enter deeper (to the left in FIG. 1) than the wood fibres. An additional distribution of the wood fibres and the heavy particles, resulting in a deflection of the heavy particles to the left (FIG. 1) during the operation of the zigzag sifter 13, is obtained by the zigzag sifter being so inclined that the folds 14' defining the zigzag shape of the sheets 14 are inclined 5°–20° downwards in relation to the horizontal plane in a direction away from the Coanda sifter. In the illustrated embodiment, this inclination is about 15°.

A conveyor screw 16 is arranged in the lower, left-hand part (FIG. 1) of the zigzag sifter 13 for removing the heavy particles separated in the zigzag sifter 13. An air supply conduit 17 opens in the lower, right-hand part (FIG. 1) of the zigzag sifter 13. A fan 18 is provided, via the conduit 17, to blow a flow of transport air into the zigzag sifter 13. This flow transports the wood fibres through the zigzag sifter while the heavy particles (latex particles) are separated therein and drop on to the conveyor screw 16.

The zigzag sifter 13 has an upper outlet 19 having an upwardly decreasing cross-sectional area and communicating with a transport conduit 20 for transporting the wood fibres freed from heavy particles to the forming station. In its upper portion, the transport conduit 20 has a 180° bend, after which it is divided into two separate conduits **20*a* and 20*b*, of which the conduit 20*a* passes on to the forming station and the conduit 20*b* returns to the zigzag sifter 13 and opens at the mouth of the conduit 17. Guide baffles 21 are arranged in the lower part of the conduit 20*b***.

The flow of air-material consisting of transport air and wood fibres is accelerated in the outlet 19 as a result of the decreasing cross-sectional area thereof. The flow then has a high velocity in the bend of the transport conduit 20, causing the wood fibres therein to be flung outwards so as to follow the outer wall of the bend in order, together with a portion of the transport air, to be guided into the conduit **20*a*, leading to the forming station. The rest of the transport air is guided into the conduit 20*b*** and recycled to the zigzag sifter.

The device described above yields a good result also in the separation of latex particles from wood fibres derived from rubber trees. This is assumed in particular to depend on the distribution of the particles across the width of the channels 15 which is brought about with the aid of the Coanda sifter and to which the inclination of the zigzag sifter 13 also contributes.

Since the particles are spread over the width of the zigzag sifter 13, such that the particles will enter deeper into the sifter (i.e. farther to the left in FIG. 1) the heavier they are, the wood fibres freed from heavy particles may, if so desired, easily be divided, for example into two fractions. This is done by dividing the upper outlet 19 of the zigzag sifter 13 into two separate outlets, one disposed over the upper, left-hand part (FIG. 1) of the zigzag sifter 13, and the other over the upper, right-hand part (FIG. 1) thereof.

I claim:

1. A method for separating heavy particles from a particulate material which contains the heavy particles, comprising the steps of:

transporting the particulate material in a substantially downwardly-directed flow to a Coanda sifter;

conducting the particulate material, in the Coanda sifter, over a downwardly-facing, convexly single-curved surface such that a direction of motion is imparted to particles of the particulate material, the direction of motion of the particles being dependent on a weight of the particles;

guiding the particles into a zigzag sifter disposed after the Coanda sifter, the zigzag sifter having a plurality of zigzag-shaped, substantially vertical walls, the walls defining channels between them, the channels extending upwards in zigzag fashion;

guiding the particles into the channels of the zigzag sifter in a lower portion of the zigzag sifter and from a side of the zigzag sifter, the side being substantially parallel to the walls;

transporting the particles up through the zigzag-shaped channels by means of a flow of transport air; and setting the flow of transport air such that the heavy particles are separated in the zigzag sifter.

2. A device for separating heavy particles from a particulate material, the particulate material containing the heavy particles comprising:

a first station for containing a supply of particulate material containing heavy particles;

a second station for receiving particulate material from which heavy particles have been removed;

a Coanda sifter;

means for directing a substantially downwardly-directed flow of the particulate material from the first station to the Coanda sifter;

the Coanda sifter having a downwardly-facing, convexly single-curved surface for imparting a direction of motion to particles of the particulate material, the direction of motion being dependent on a weight of the particles;

a zigzag sifter disposed between the Coanda sifter and the second station, the zigzag sifter having a plurality of zigzag-shaped, substantially vertical walls which are substantially perpendicular to an axis of curvature of the single-curved surface the walls defining channels between them, the channels extending upwards in zigzag fashion, the zigzag sifter being arranged relative to the Coanda sifter such that the zigzag sifter is adapted to receive particles from the Coanda sifter in a lower portion of the zigzag sifter and in a side of the zigzag sifter.

3. A device as claimed in claim 2, wherein the walls have a zigzag shape, the zigzag shape being defined by folds, the folds being inclined 5°–20° downwards in relation to a horizontal plane and in a direction away from the Coanda sifter.

4. The device as claimed in claim 2, further comprising means for forcing a flow of air upwards through the zigzag sifter.

5. The device as claimed in claim 4, further comprising means for adjusting a flow rate of the flow of air.

6. The device as claimed in claim 2, wherein the first station is a container.

7. The device as claimed in claim 2, wherein the second station is a plant for making fiberboard.

* * * * *